US009570796B2

(12) United States Patent
Alrabadi et al.

(10) Patent No.: US 9,570,796 B2
(45) Date of Patent: Feb. 14, 2017

(54) ANTENNA FOR MOBILE DEVICE HAVING METALLIC SURFACE

(71) Applicants: Osama Nafeth Alrabadi, Aalborg (DK); Alexandru Daniel Tatomirescu, Aalborg (DK); Mikael Bergholz Knudsen, Gistrup (DK); Gert F. Pedersen, Storvorde (DK); Poul Olesen, Stovring (DK); Peter Bundgaard, Aalborg (DK)

(72) Inventors: Osama Nafeth Alrabadi, Aalborg (DK); Alexandru Daniel Tatomirescu, Aalborg (DK); Mikael Bergholz Knudsen, Gistrup (DK); Gert F. Pedersen, Storvorde (DK); Poul Olesen, Stovring (DK); Peter Bundgaard, Aalborg (DK)

(73) Assignee: Intel IP Corporation, Santa Clara, CA (US)

( * ) Notice: Subject to any disclaimer, the term of this patent is extended or adjusted under 35 U.S.C. 154(b) by 461 days.

(21) Appl. No.: 14/064,800

(22) Filed: Oct. 28, 2013

(65) Prior Publication Data

US 2015/0116158 A1 Apr. 30, 2015

(51) Int. Cl.

| | |
|---|---|
| ***H01Q 13/10*** | (2006.01) |
| ***H01Q 1/24*** | (2006.01) |
| ***H01Q 1/44*** | (2006.01) |

(52) U.S. Cl.

CPC ..... *H01Q 1/243* (2013.01); *H01Q 1/44* (2013.01); *H01Q 13/103* (2013.01)

(58) Field of Classification Search

CPC ..... H01Q 13/103; H01Q 1/44

See application file for complete search history.

(56) References Cited

U.S. PATENT DOCUMENTS

| | | | | |
|---|---|---|---|---|
| 2005/0195758 | A1* | 9/2005 | Chitrapu | H04B 7/2615 370/279 |
| 2011/0050508 | A1 | 3/2011 | Guterman et al. | |
| 2012/0188917 | A1* | 7/2012 | Knox | H01Q 1/2225 370/277 |

OTHER PUBLICATIONS

Rainville, et al., Magnetic Tuning of a Microstrip Patch Antenna Fabricated on a Ferrite Film, IEEE Microw. and Guided Wave Lett., vol. 2, No. 12, pp. 483-485, Dec. 1992.

Mishra, et al., "Tuning of Microstrip Antenna on Ferrite Substrate", IEEE Trans. Antennas Propag., vol. 41, No. 2, pp. 230-233, Feb. 1993.

Aberle, et al., Reconfigurable Antennas for Wireless Devices, IEEE Antennas and Propagation Magazine, vol. 45, No. 6, pp. 148-154, Dec. 2003.

(Continued)

*Primary Examiner* — Hoang V Nguyen
*Assistant Examiner* — Michael Bouizza
(74) *Attorney, Agent, or Firm* — Schiff Hardin LLP

(57) ABSTRACT

An antenna having a plurality of ports coupled to at least one radiator opening or protuberance formed on a metallic surface. A plurality of modulators are coupled to the plurality of respective ports and configured to modulate phase or amplitude of a plurality of signals radiated at the plurality of respective ports. A combiner is configured to combine the modulated signals to substantially cancel power reflected from the plurality of respective ports, wherein the plurality of respective ports are functionally aggregated into a single port.

23 Claims, 6 Drawing Sheets

(56) References Cited

OTHER PUBLICATIONS

Panayi, et al., Tuning Techniques for Planar Inverted-F Antenna, Electronics Letters, vol. 37, No. 16, pp. 1003-1004, Aug. 2001.
Sheta, et al., A Widely Tuneable Compact Patch Antenna, IEEE Transactions on Antennas and Propagation Letters, vol. 7, pp. 40-42, 2008.
Peroulis, et al., Design of Reconfigurable Slot Antennas, IEEE Transactions on Antennas and Propagation, vol. 53, No. 2, pp. 645-654, Feb. 2005.
Xiong, et al., A Simple Compact Reconfigurable Slot Antenna With a Very Wide Tuning Range, IEEE Transactions on Antennas and Propagation, vol. 58, No. 11, pp. 3725-3728, Nov. 2010.
Kawasaki, A Slot Antenna With Electronically Tunable Length, International Symposium on Antennas and Propagation Society, AP-S Digest, vol. 1, pp. 130-133, Jun. 1991.
Ollikainen, et al., Low-Loss Tuning Circuits for Frequency-Tunable Small Resonant Antennas, Symposium on Personal, Indoor and Mobile Radio Communications, vol. 4, pp. 1882-1887, Sep. 15-18, 2002.
Valkonen, et al., Broadband Tuning of Mobile Terminal Antennas, Second European Conference on Antennas and Propagation, 2007 (EuCap 2007), pp. 1-6, Nov. 11-16, 2007.

* cited by examiner

S Parameters for Antenna of Figures 2A and 2B

Antenna of Figures 2A and 2B tuned for 698 MHz

Antenna of Figures 2A and 2B tuned for 698 MHz

ANTENNA FOR MOBILE DEVICE HAVING METALLIC SURFACE

TECHNICAL FIELD

Embodiments described herein generally relate to an antenna for a mobile device having a metallic surface, a mobile device having the antenna, and a method of operating the antenna.

BACKGROUND

Metallic cases have the potential to offer designers the freedom to make mobile devices very thin. There is design trend toward all-metal cases, but there is also a fundamental limitation to the percentage of the mobile device case area that can be metallic.

Slots in the surface of the metallic case may be used to obtain acceptable radiation performance. However, when the size of the mobile device is small compared to the frequency of operation, the inefficient radiation and narrow-band nature of slot antennas are drawbacks. Furthermore, slots are highly susceptible to detuning by the presence of the user's relatively high dielectric and lossy tissue. To combat its narrow band nature, a slot antenna can be made tunable to cover an instantaneous bandwidth. However, due to the wide bandwidth used by the Long Term Evolution (LTE)-advanced protocol, tuning of single slot antennas cannot cover all instantaneous bandwidths required for future wireless platforms.

DESCRIPTION OF THE EMBODIMENTS

The present disclosure is directed to an antenna having a plurality of ports coupled to at least one radiator opening or protuberance formed on a metallic surface. A plurality of modulators are coupled to the plurality of respective ports and configured to modulate phase or amplitude of a plurality of signals radiated at the plurality of respective ports. A combiner is configured to combine the modulated signals to substantially cancel power reflected from the plurality of respective ports, wherein the plurality of respective ports are functionally aggregated into a single port.

Figure 1:
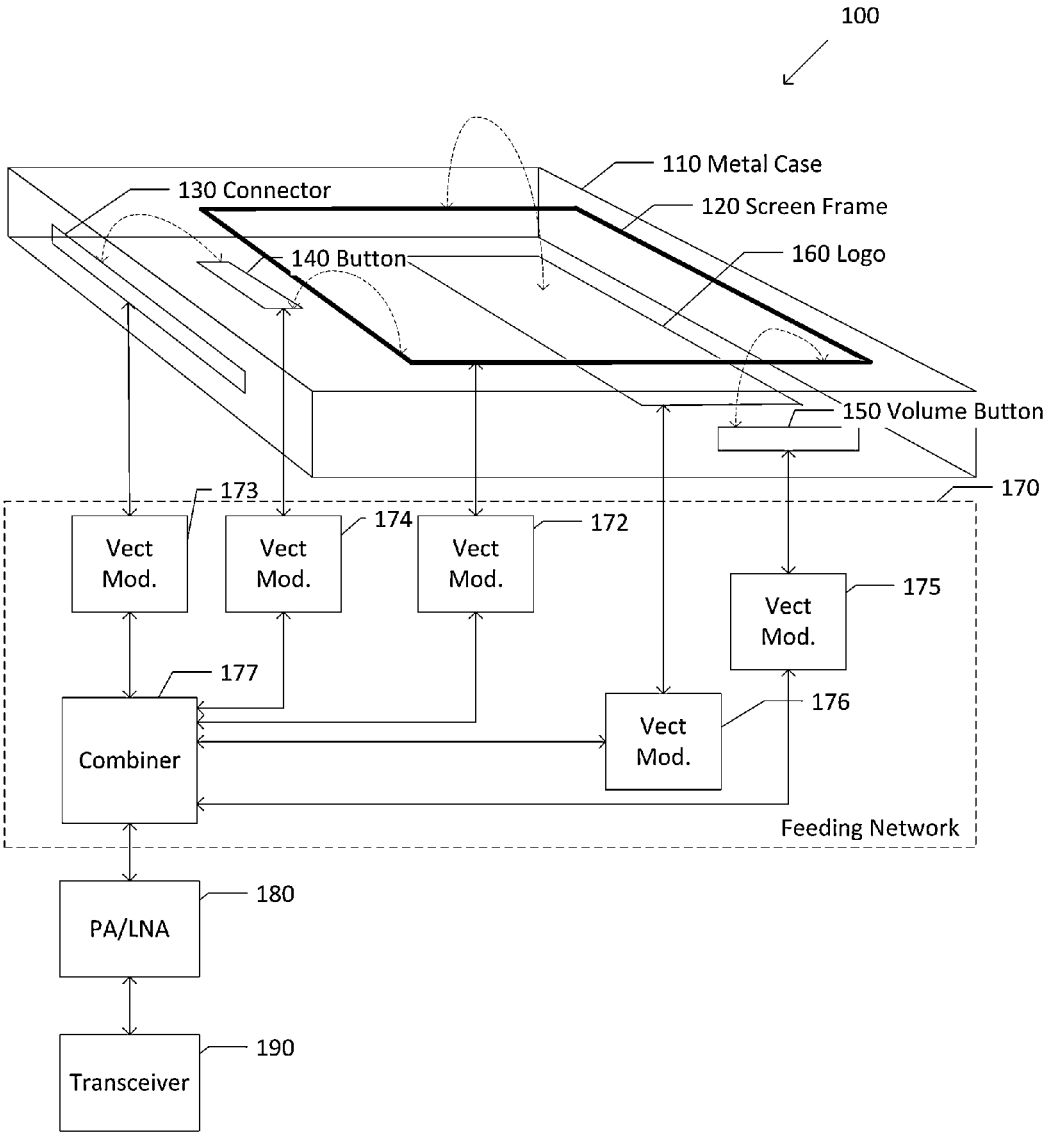
FIG. 1 is a schematic diagram illustrating a handheld device having an antenna in accordance with an exemplary embodiment.

FIG. 1 is a schematic diagram illustrating a handheld device 100 having an antenna in accordance with an exemplary embodiment. Handheld device 100 includes a metallic case 110, feeding network 170, power amplifier (PA)/low noise amplifier (LNA) 180, and transceiver 190.

Metallic case 110 comprises a surface having openings and/or protuberances, any of which can function as a radiator of an antenna. These openings/protuberances may comprise any arbitrary shape, and include, for example, screen frame 120, dock and power connector 130, button 140, volume button 150, logo 160, and/or openings on the surface of the metallic case 110 to accommodate the respective components. A "logo" is loosely defined as a graphic mark or emblem commonly used by commercial enterprises, organizations and even individuals to aid and promote instant public recognition. The openings/protuberances may alternatively be any of a slot antenna, patch antenna, loop antenna, dipole antenna, or monopole antenna. The length of an opening/protuberance determines its bandwidth, which is the range of frequencies over which the radiator opening/protuberance can properly radiate or receive energy. It is appreciated that the openings and protuberances listed are merely examples, and the disclosure is not limited in this respect.

A port (not shown in FIG. 1) may be located on any opening/protuberance that is configured to function as a radiator. A "port" is loosely defined as any location on an opening/protuberance where voltage and current can be delivered. There can be one port, or alternatively a plurality of ports, on a single radiator opening/protuberance.

Feeding network 170 includes vector modulators 172-176 and combiner 177. Vector modulators 172-176, which couple combiner 177 with respective ports of the radiator openings/protuberances, are configured to modulate phase and/or amplitude of signals radiated at the respective ports.

Combiner 177 is configured to combine the vector modulated signals such that power reflected from the ports is substantially cancelled, and as a result, the ports are functionally aggregated into a single port. A more detailed explanation follows.

By way of background, power transfer is maximized when electrical components are designed to have matching impedance. This is known simply as "impedance matching." The industry standard impedance for electrical components is 50 ohms, though the disclosure is not limited in this respect.

Voltage Standing Wave Ratio (VSWR) is a measure that numerically describes how well electrical components are impedance-matched. VSWR is a function of the reflection coefficient, which describes the amount of power reflected. The smaller the VSWR, the better the components are matched, and the greater the power delivered. The ideal value of VSWR is 1.0, which indicates that no power is reflected and all power is instead radiated. On the other hand, when the impedances of components are not well matched, at least some portion of power is reflected back instead of being radiated. The superposition of reflected waves traveling back and forth on a transmission line forms a standing wave. The VSWR represents the ratio between the maximum and minimum amplitude of the standing wave.

Turning back to FIG. 1, each vector modulator 172-176 is tuned such that its impedance matches its port. The result should be that during antenna transmission no significant amount of power is reflected back from the port, but is instead radiated from the corresponding radiator opening/protuberance. If the impedance is not well matched, on the other hand, power is reflected back towards combiner 177 rather than reaching the port. The resulting standing wave along the vector modulator 172-176 can cause inefficiencies and even damage to PA/LNA 180. As those of skill should appreciate, similar concepts apply during antenna reception. Combiner 177 is bidirectional; during antenna reception is functionally a splitter, but for the sake of simplicity, the more general term "combiner" is used.

A vector modulator 172-176 may be any phase shifter implementation or tunable transmission line. In the exemplary embodiment a coaxial cable has been chosen for ease of fabrication, but the disclosure is not limited in this respect. By varying the electrical length of vector modulator 172-176 (i.e., the coaxial cable), the impedance of the vector modulator 172-176, and thus the input impedance of the respective port, is determined.

Each port may be affected by any other port due to coupling. Coupling, as shown in the figure by the dotted double arrows, is radiating power absorbed by one port when a nearby port is operating. It is appreciated that in operation each port may couple to any or all of the other ports, but only some of the dotted double arrows are shown for the sake of simplicity.

Combiner 177 is configured to combine modulated signals such that power reflected from ports is substantially cancelled. If a significant amount of power is reflected from a port returns to the output of PA/LNA 180, the resulting standing wave may reduce the efficiency of or burn the PA/LNA 180.

It is appreciated that there may be more than one combiner. Different vector modulators 172-176 may be coupled to different combiners, and then the plurality of combiners may be coupled so as to combine all of the modulated signals.

Remote feeding of a port is possible due to port coupling. Energy radiating from a first port may be coupled to and radiated partially or almost completely from a second port. A port being fed is therefore physically separated from a port doing the actual radiating. Also, it is appreciated that remote feeding is not limited to two ports, but may include any number of ports.

As mentioned above, the length of an opening/protuberance determines its bandwidth. Openings/protuberances may be configured to operate at different bandwidths, making metal body 110 a multi-bandwidth antenna. The openings/protuberances chosen to radiate at a particular time of operation would be determined based on the frequency band of a base station with which the mobile device is communicating.

Modulating by vector modulator 172-176 of the radiated signals may be accomplished statically or dynamically. Static tuning generally occurs at the time of mobile device manufacture, and may include setting the length of the vector modulator 172-176. Dynamic tuning, on the other hand, occurs in the field, making it possible to compensate for impedance detuning introduced by a user's influence, thus eliminating mismatch loss or reduction in the PA/LNA 180's efficiency. When user grabs a phone, power detectors may detect detuning. Vector modulators 172-176 would respond by adjusting the bandwidth channels back into tune. Alternatively, when a user's finger covers one port, other ports can be used to radiate efficiently.

Tuning techniques may use tunable substrates or tunable components. The tunable components are built based on electrically controlled reactances or on passive reactances with a switching component. Electrically controlled reactances are mainly varactor diodes, also known as variable capacitor diode or varicap, which deliver different capacitances in function on the voltage impressed on its terminals. Switching components can be electronic or electromechanical. Electronic switches are semiconductor switches, such as PIN diodes and reactive Field Effect Transistor (FET). Electromechanical switches rely on RF Micro-Electro-Mechanical (MEMS) switches.

Figure 2A:
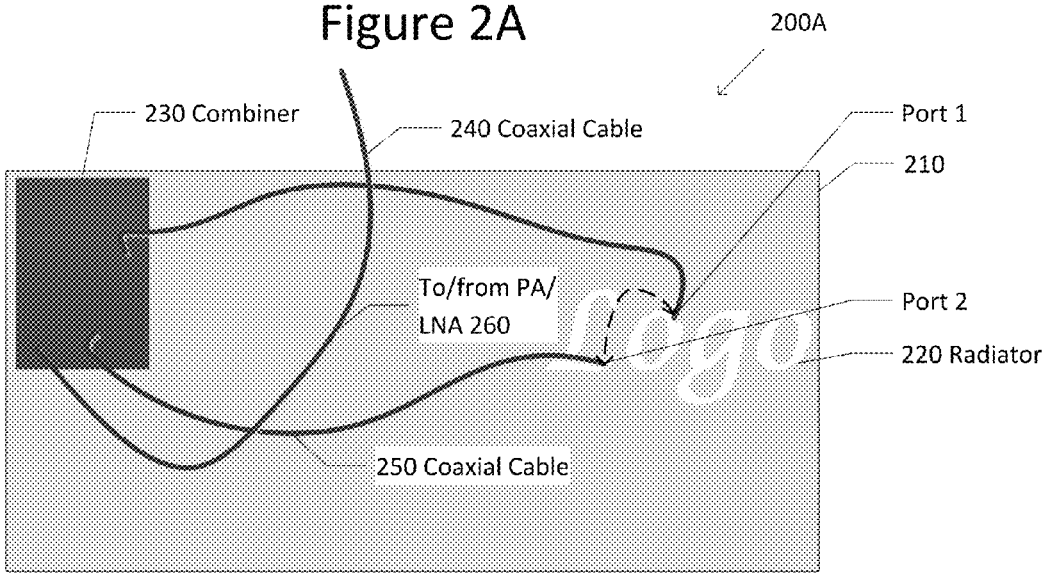
FIG. 2A is a schematic diagram illustrating an antenna in accordance with an exemplary embodiment.
Figure 2B:
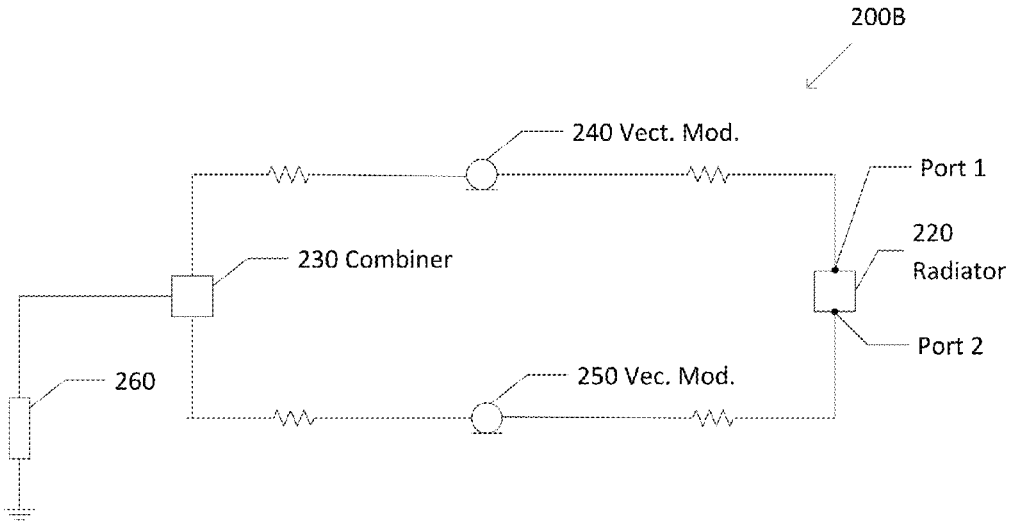
FIG. 2B is a circuit diagram corresponding to the schematic diagram of FIG. 2A.

FIG. 2A is a schematic diagram 200A illustrating an antenna with feeding network in accordance with an exemplary embodiment. FIG. 2B is a circuit diagram 200B corresponding to the schematic diagram 200A of FIG. 2A.

In this exemplary embodiment, logo 220 is made into an antenna for a mobile device. In this example, the metal plate size is 120 mm×55 mm, representing the smart phone form factor. Logo 220 is etched into a copper plate having two ports, port 1 and port 2. Logo radiator element 220 has a size of 34 mm×24 mm. When port 1 and port 2 radiate, there is a coupling between the port 1 and port 2, as indicated by the dotted double arrow. Vector modulators 240, 250 modulate phase and/or amplitude of signals radiated at the respective ports. Combiner 230 combines the modulated signals such that power reflected from the ports is substantially cancelled, whereby the ports are functionally aggregated into a single port. By merely modulating the phase and/or amplitude of the radiating signals, ports 1, 2 can be tuned to cover any desired communication bandwidth.

Figure 3:
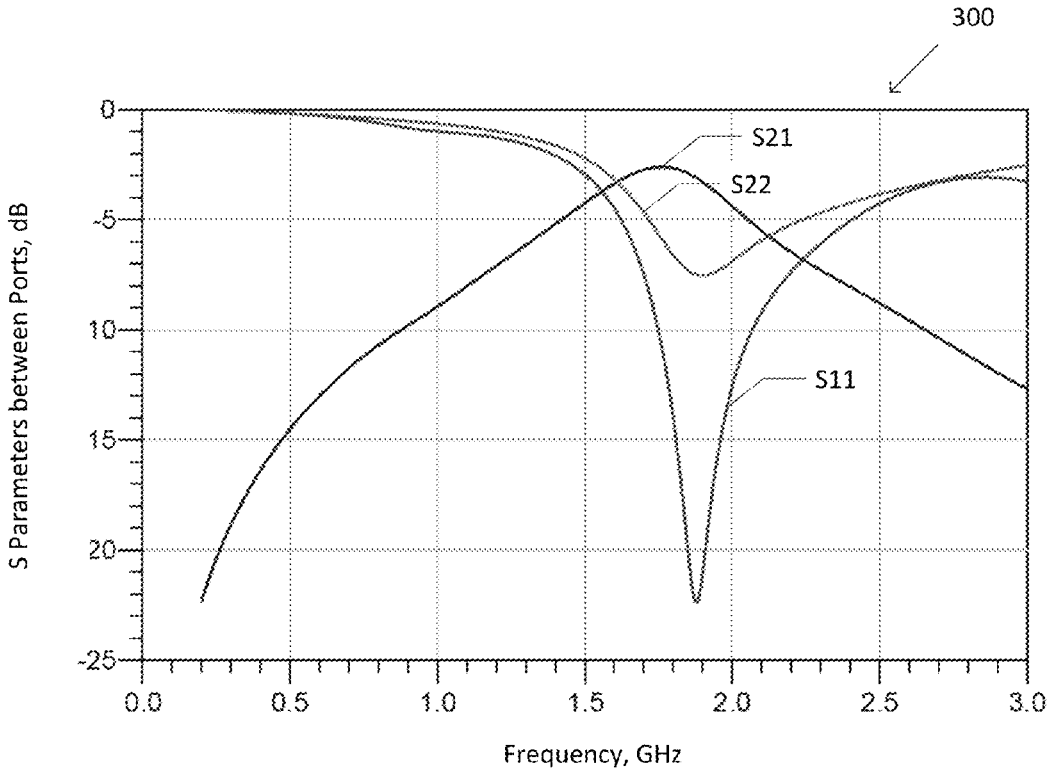
FIG. 3 is a graph illustrating S-parameters versus frequency for the antenna of FIGS. 2A and 2B.

FIG. 3 is a graph illustrating S-parameters between port 1 and port 2 versus frequency for the antenna of FIG. 2A, as measured using a Vector Network Analyzer (VNA).

S-parameters describe the relationship between ports. S12 represents the power received at port 1 relative to the power input to port 2. S21 represents the power received at port 2 relative to the power input to port 1; S12 is the equivalent to S21. S21=0 dB means that all power delivered to port 1 ends up at the port 2.

S11 represents how much power is reflected from port 1, and hence is known as the reflection coefficient (sometimes written as gamma I⁻ or return loss). S11 is directly related to VSWR described above. Where S11=0 dB, all the power is reflected from port 1 and nothing is radiated. At 0.5 GHz, port 1 radiates virtually nothing, as S11 is close to 0 dB, so all of the power is reflected. Port 1's natural resonance, that is the frequency at which the port radiates best, is 1.9 GHz, where S11=−22 dB. It can be seen at this, there is strong coupling between the two ports, as indicated by curve S21.

Figure 4A:
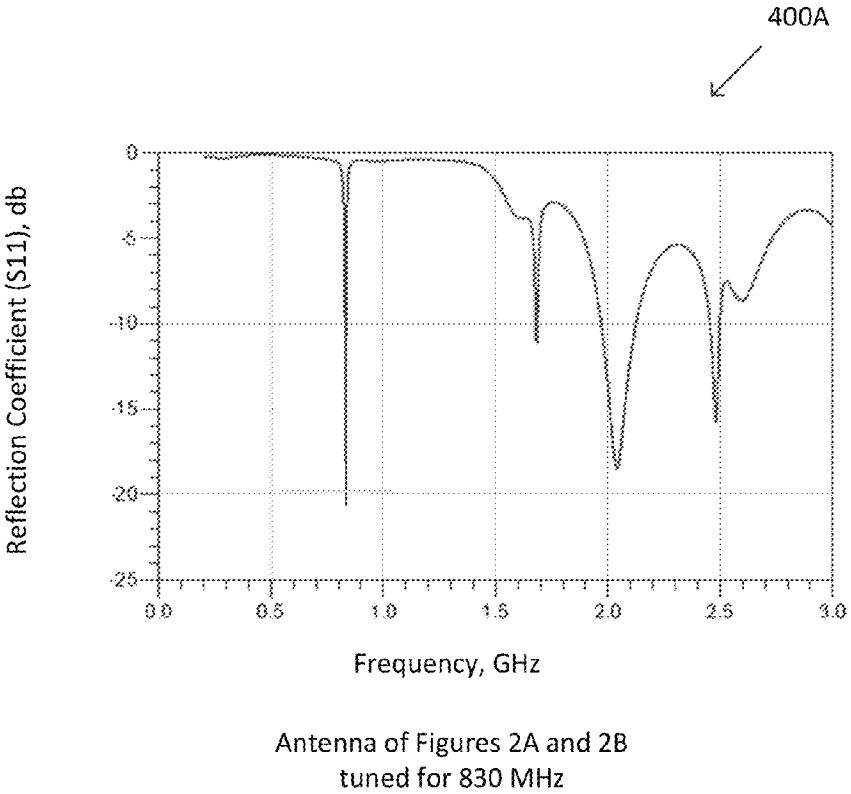
FIG. 4A is a graph illustrating reflection coefficient versus frequency when the antenna of FIGS. 2A and 2B is tuned to 830 MHz in accordance with an exemplary embodiment.
Figure 4B:
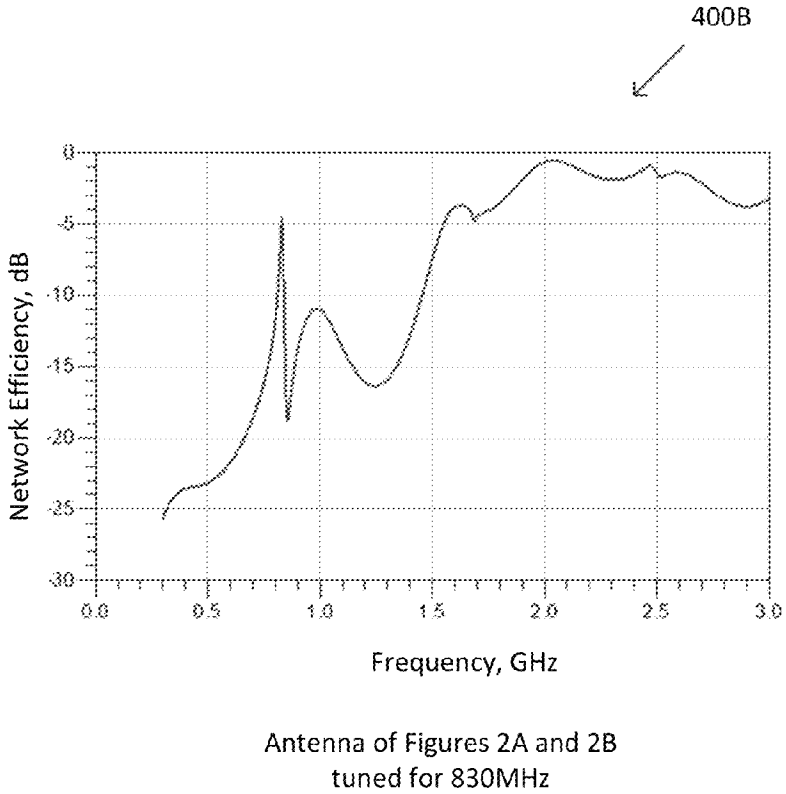
FIG. 4B is a graph illustrating network efficiency verses frequency when the antenna of FIGS. 2A and 2B is tuned to 830 MHz in accordance with an exemplary embodiment.

FIG. 4A is a graph illustrating reflection coefficient versus frequency when the antenna of circuit diagram 200 shown in FIGS. 2A and 2B is tuned to 830 MHz in accordance with an exemplary embodiment. FIG. 4B is a corresponding graph illustrating network efficiency verses frequency. The two coaxial cables 240, 250 are, in this exemplary embodiment, 102 mm and 94 mm long, respectively.

The network efficiency represents the ratio between the total power accepted by the antenna and the input power. The closer to 0 dB, which represents an efficiency of 1, the more efficient the network. The total efficiency of the antenna is related to the network efficiency by the following Equation (1):

$$\eta_Tot=\eta_Network*\eta_Rad \quad \text{(Equation 1)}$$

where η_Tot is the total efficiency, η_Network is the network efficiency and η_Rad is the radiation efficiency. As can be seen in FIG. 4A, Port 1's natural resonance is at 830

MHz. The figure shows that the radiation efficiency of the antenna is high, around 90%, so the main source of losses is the network.

Figure 5A:
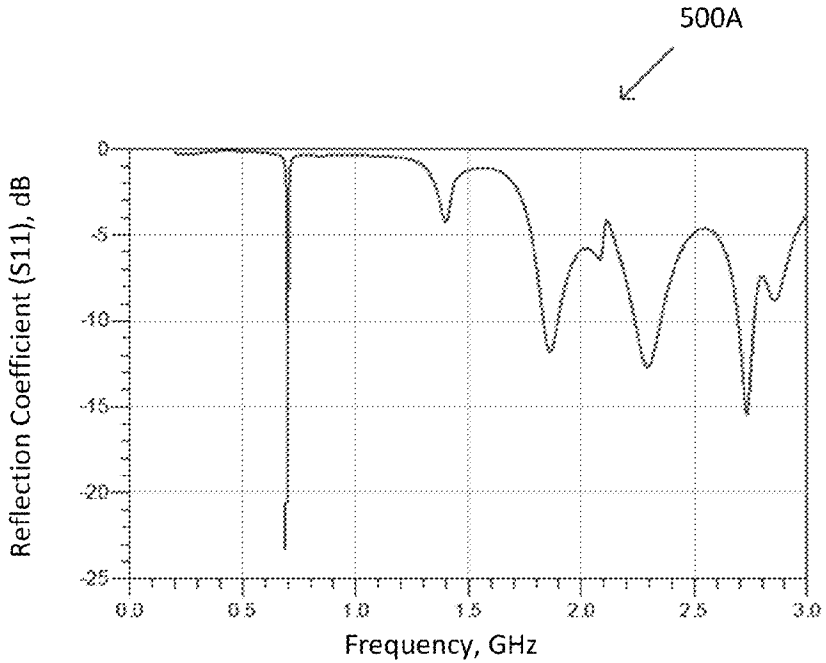
FIG. 5A is a graph illustrating reflection coefficient versus frequency when the antenna of FIGS. 2A and 2B is tuned to 698 MHz in accordance with an exemplary embodiment.
Figure 5B:
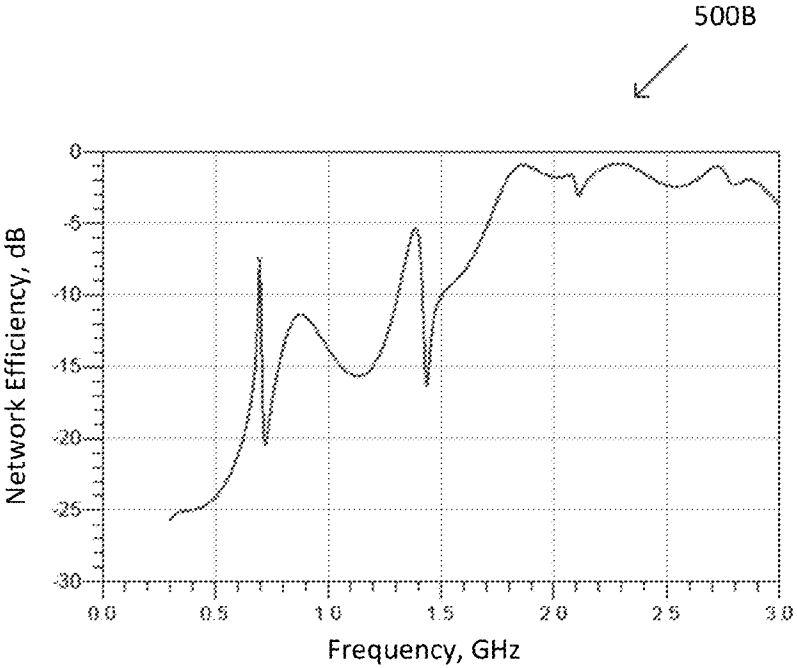
FIG. 5B is a graph illustrating network efficiency verses frequency when the antenna of FIGS. 2A and 2B is tuned to 698 MHz in accordance with an exemplary embodiment.

FIG. 5A is a graph illustrating reflection coefficient versus frequency, and FIG. 5B a graph illustrating network efficiency verses frequency, when the same antenna of circuit diagram 200 is tuned to 698 MHz, as opposed to 830 MHz in FIGS. 4A and 4B, in accordance with an exemplary embodiment.

By increasing the physical or electrical length of the coaxial cables 240, 250 by only 15%, the antenna is tuned to the lower 698 MHz band. In practice the coaxial cable 240, 250 length increase or decrease can be implemented be any tuning method, such as impedance loading or switched transmission line. As it can be seen in the figures, Port 1's natural resonance is at 698 MHz.

Figure 6:
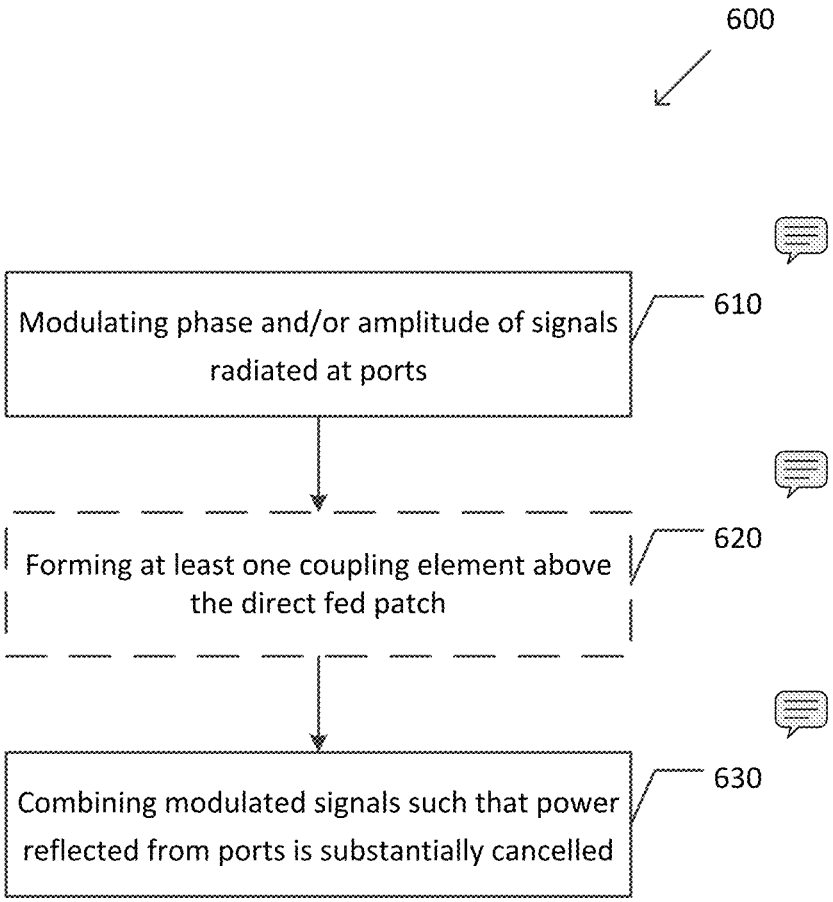
FIG. 6 is a flowchart illustrating a method of operating an antenna in accordance with an exemplary embodiment.

FIG. 6 is a flowchart illustrating a method of operating an antenna in accordance with an exemplary embodiment.

At step 610, the phase and/or amplitude of signals radiated at respective ports coupled to at least one radiator opening formed on a surface of a metallic case are modulated.

Next, at step 630, the modulated signals are combined such that reflected portions of the radiated signals are substantially cancelled.

Optionally, at Step 620, if dynamic modulation is desired, impedance mismatch of at least one of the ports is detected before the combining step is performed.

Driving an antenna with multiple independently-fed ports enables the use of unconventional antenna structures, relaxes design requirements, and permits all-metal bodies for the mobile devices. Any feeding method may be used to combine arbitrarily shaped openings/protuberances on a surface of a metallic case of a mobile device, thereby transforming the metallic case into a multi-band or wide-band antenna that has redundancy to the user's disturbance and full control of the aggregate system bandwidth. In addition, electromagnetic coupling between ports helps to distribute the current concentration, thereby limiting conductive losses and enabling separation of a feeding port from a radiating port.

The ports can be tuned to aggregate bandwidth carriers in accordance with the LTE-advanced standard. As is known, carriers can be aggregated in a manner that is intra-band contiguous, intra-band non-contiguous, or inter-band.

The following examples pertain to further embodiments.

Example 1 is an antenna comprising a plurality of ports coupled to at least one radiator opening or protuberance formed on a metallic surface, a plurality of modulators coupled to the plurality of respective ports and configured to modulate phase or amplitude of a plurality of signals radiated at the plurality of respective ports, and a combiner configured to combine the modulated signals to substantially cancel power reflected from the plurality of respective ports, wherein the plurality of respective ports are functionally aggregated into a single port.

In Example 2, the subject matter of Example 1 can optionally include that the metallic surface is an all-metallic case.

In Example 3, the subject matter of Example 1 can optionally include that the at least one radiator opening or protuberance comprises any arbitrary shape.

In Example 4, the subject matter of Example 3 can optionally include that the radiator opening or protuberance comprises a shape in a form of a logo.

In Example 5, the subject matter of Example 1 can optionally include a plurality of radiator openings or protuberances or a combination of radiator openings and protuberances, wherein each of the plurality of radiator openings and/or protuberances comprises at least one port.

In Example 6, the subject matter of Example 1 can optionally include that the antenna is a multiband antenna, and each of the at least one radiator opening or protuberance corresponds to a respective frequency band.

In Example 7, the subject matter of Example 1 can optionally include that the plurality of modulators are further configured to modulate the phase or amplitude of signals radiated at the respective ports, wherein a first of the plurality of ports is a feeding port and a second of the plurality of ports is a transceiving port.

In Example 8, the subject matter of Example 1 can optionally include that at least one of the modulators is a dynamic modulator configured to compensate for impedance mismatch introduced during operation of the antenna.

In Example 9, the subject matter of Example 8 can optionally include that the dynamic modulator comprises a tunable electric component.

In Example 10, the subject matter of Example 8 can optionally include a plurality of detectors coupled to one or more of the plurality of ports and configured to detect impedance mismatch of at least one of the plurality of ports during operation.

In Example 11, the subject matter of Example 1 can optionally include that at least one of the modulators is a static modulator.

In Example 12, the subject matter of Example 1 can optionally include that at least one of the modulators is comprised of a tunable transmission line.

In Example 13, the subject matter of Example 12 can optionally include that the tunable transmission line is a coaxial cable.

In Example 14, the subject matter of Example 1 can optionally include that the at least one radiator opening or protuberance is selected from the group consisting of a slot antenna, patch antenna, loop antenna, dipole antenna, monopole antenna, button screen frame, logo, and connector.

In Example 15, the subject matter of Example 1 can optionally include that the radiator opening is a slot.

Example 16 is a handheld device comprising the antenna of Example 1, a power amplifier coupled to the combiner, and a transceiver coupled to the power amplifier.

In Example 17, the subject matter of Example 16 can optionally include that the at least one radiator opening or protuberance comprises any arbitrary shape.

Example 18 is an antenna comprising a plurality of ports coupled to at least one radiator opening or protuberance formed on a metallic surface, a modulating means, respectively coupled to the plurality of ports, for modulating phase or amplitude of signals radiated at the plurality of respective ports, and a combining means for combining the modulated signals to substantially cancel power reflected from the plurality of ports, wherein the plurality of ports are functionally aggregated into a single port.

In Example 19, the subject matter of Example 18 can optionally include that the at least one radiator opening or protuberance comprises any arbitrary shape.

Example 20 is a method of operating an antenna, the method comprising modulating phase or amplitude of signals radiated at a plurality of respective ports coupled to at least one radiator opening or protuberance formed on a metallic surface, and combining the modulated signals to substantially cancel power reflected from the plurality of ports, wherein the plurality of ports are functionally aggregated into a single port.

In Example 21, the subject matter of Example 20 can optionally include detecting impedance mismatch of at least one of the plurality of ports.

In Example 22, the subject matter of Example 20 can optionally include that the modulating is performed during operation of the antenna.

In Example 23, the subject matter of Example 20 can optionally include modulating the phase or amplitude of signals radiated at the plurality of respective ports wherein a first of the plurality of ports is a feeding port and a second of the plurality of ports is a transceiving port.

In Example 24, the subject matter of any of Examples 1-2 can optionally include that the at least one radiator opening or protuberance comprises any arbitrary shape.

In Example 25, the subject matter of any of Examples 1-3 can optionally include that the radiator opening or protuberance comprises a shape in a form of a logo.

In Example 26, the subject matter of any of Examples 1-4 can optionally include a plurality of radiator openings or protuberances or a combination of radiator openings and protuberances, wherein each of the plurality of radiator openings and protuberances comprises at least one port.

In Example 27, the subject matter of any of Examples 1-4 can optionally include that the antenna is a multiband antenna, and each of the at least one radiator opening or protuberance corresponds to a respective frequency band.

In Example 28, the subject matter of any of Examples 1-6 can optionally include that the plurality of modulators are further configured to modulate the phase or amplitude of signals radiated at the respective ports, wherein a first of the plurality of ports is a feeding port and a second of the plurality of ports is a transceiving port.

In Example 29, the subject matter of any of Examples 1-7 can optionally include that at least one of the modulators is a dynamic modulator configured to compensate for impedance mismatch introduced during operation of the antenna.

In Example 30, the subject matter of Example 29 can optionally include that the dynamic modulator comprises a tunable electric component.

In Example 31, the subject matter of Example 29 can optionally include a plurality of detectors coupled to one or more plurality of ports and configured to detect impedance mismatch of at least one of the plurality of ports during operation.

In Example 32, the subject matter of any of Examples 1-9 can optionally include that wherein at least one of the modulators is a static modulator.

In Example 33, the subject matter of Example 32 can optionally include that at least one of the modulators is comprised of a tunable transmission line.

In Example 34, the subject matter of Example 33 can optionally include that the tunable transmission line is a coaxial cable.

In Example 35, the subject matter of any of Examples 1-12 can optionally include that the at least one radiator opening or protuberance is selected from the group consisting of a slot antenna, patch antenna, loop antenna, dipole antenna, monopole antenna, button screen frame, logo, and connector.

In Example 36, the subject matter of any of Examples 20-21 can optionally include that the modulating is performed during operation of the antenna.

In Example 37, the subject matter of any of Examples 20-22 can optionally include modulating the phase or amplitude of signals radiated at the respective ports, wherein a first of the plurality of ports is a feeding port and a second of the plurality of ports is a transceiving port.

Example 38 is an apparatus substantially as shown and described.

Example 39 is a method substantially as shown and described.

While the foregoing has been described in conjunction with exemplary embodiment, it is understood that the term "exemplary" is merely meant as an example, rather than the best or optimal. Accordingly, the disclosure is intended to cover alternatives, modifications and equivalents, which may be included within the scope of the disclosure.

Although specific embodiments have been illustrated and described herein, it will be appreciated by those of ordinary skill in the art that a variety of alternate and/or equivalent implementations may be substituted for the specific embodiments shown and described without departing from the scope of the present application. This application is intended to cover any adaptations or variations of the specific embodiments discussed herein.

The invention claimed is:

1. An antenna, comprising:

a plurality of antenna ports coupled to at least one radiator opening or protuberance formed on a metallic surface;

a plurality of radio frequency analog modulators coupled to the plurality of respective antenna ports and configured to modulate phase or amplitude of a plurality of signals radiated at the plurality of respective ports; and a combiner configured to combine the modulated signals to substantially cancel power reflected from the plurality of respective antenna ports, wherein the plurality of radio frequency modulators and the combiner form an antenna matching circuit with a single output port and the plurality of antenna ports.

2. The antenna of claim 1, wherein the metallic surface is an all-metallic case.

3. The antenna of claim 1, wherein the at least one radiator opening or protuberance comprises any arbitrary shape.

4. The antenna of claim 3, wherein the at least one radiator opening or protuberance comprises a shape in a form of a logo.

5. The antenna of claim 1, further comprising a plurality of radiator openings or protuberances or a combination of radiator openings and protuberances, wherein each of the plurality of radiator openings and protuberances comprises at least one port.

6. The antenna of claim 1, wherein the antenna is a multiband antenna, and each of the at least one radiator opening or protuberance corresponds to a respective frequency band.

7. The antenna of claim 1, wherein the plurality of radio frequency modulators are further configured to modulate the phase or amplitude of signals radiated at the respective antenna ports, wherein a first of the plurality of antenna ports is a feeding port and a second of the plurality of antenna ports is a transceiving port.

8. The antenna of claim 1, wherein at least one of the radio frequency modulators is a dynamic radio frequency modulator configured to compensate for impedance mismatch introduced during operation of the antenna.

9. The antenna of claim 8, wherein the dynamic radio frequency modulator comprises a tunable electric component.

10. The antenna of claim 8, further comprising a plurality of detectors coupled to one or more of the plurality of antenna ports and configured to detect impedance mismatch of at least one of the plurality of antenna ports during operation.

11. The antenna of claim 1, wherein at least one of the radio frequency modulators is a static radio frequency modulator.

12. The antenna of claim 1, wherein at least one of the radio frequency modulators is comprised of a tunable transmission line.

13. The antenna of claim 12, wherein the tunable transmission line is a coaxial cable.

14. The antenna of claim 1, wherein the at least one radiator opening or protuberance is selected from the group consisting of a slot antenna, patch antenna, loop antenna, dipole antenna, monopole antenna, button screen frame, logo, and connector.

15. The antenna of claim 1, wherein the radiator opening is a slot.

16. A handheld device, comprising:

the antenna of claim 1;

a power amplifier coupled to the combiner; and a transceiver coupled to the power amplifier.

17. The antenna of claim 16, wherein the at least one radiator opening or protuberance comprises any arbitrary shape.

18. An antenna, comprising:

a plurality of antenna ports coupled to at least one radiator opening or protuberance formed on a metallic surface;

a radio frequency analog modulating means, respectively coupled to the plurality of antenna ports, for modulating phase or amplitude of signals radiated at the plurality of respective antenna ports; and a combining means for combining the modulated signals to substantially cancel power reflected from the plurality of antenna ports, wherein the plurality of radio frequency modulators means and the combining means form an antenna matching means with a single output port and the plurality of antenna ports.

19. The antenna of claim 18, wherein the at least one radiator opening or protuberance comprises any arbitrary shape.

20. A method of operating an antenna, the method comprising:

modulating, by a plurality of radio frequency analog modulators, phase or amplitude of signals radiated at a plurality of respective antenna ports coupled to at least one radiator opening or protuberance formed on a metallic surface; and combining, by a combiner, the modulated signals to substantially cancel power reflected from the plurality of antenna ports, wherein the plurality of radio frequency modulators and the combiner form an antenna matching circuit with a single output port and the plurality of antenna ports.

21. The method of claim 20, further comprising detecting impedance mismatch of at least one of the plurality of antenna ports.

22. The method of claim 20, wherein the modulating is performed during operation of the antenna.

23. The method of claim 20, further comprising modulating the phase or amplitude of signals radiated at the plurality of respective antenna ports wherein a first of the plurality of antenna ports is a feeding port and a second of the plurality of antenna ports is a transceiving port.

* * * * *